US008585110B2

(12) United States Patent
Belik

(10) Patent No.: US 8,585,110 B2
(45) Date of Patent: Nov. 19, 2013

(54) INTERNAL PIPE GRIPPING TOOL

(75) Inventor: Jaroslav Belik, Smithville, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/342,002

(22) Filed: Dec. 31, 2011

(65) Prior Publication Data

US 2013/0168984 A1 Jul. 4, 2013

(51) Int. Cl.
*B66C 1/54* (2006.01)

(52) U.S. Cl.
USPC ..... 294/96; 294/86.25

(58) Field of Classification Search
USPC ..... 294/86.24, 86.25, 93, 94, 96
See application file for complete search history.

(56) References Cited

U.S. PATENT DOCUMENTS

| | | | | | |
|---|---|---|---|---|---|
| 1,455,314 | A | * | 5/1923 | Watkins | 294/86.14 |
| 1,528,561 | A | | 3/1925 | Nixon | |
| 1,619,254 | A | * | 3/1927 | Hart | 294/86.15 |
| 1,712,898 | A | | 5/1929 | Newkirk | |
| 1,776,737 | A | | 9/1930 | Miller | |
| 1,785,590 | A | | 12/1930 | Miller | |
| 1,834,316 | A | | 12/1931 | McLagan | |
| 2,108,499 | A | | 2/1938 | Moseley | |
| 2,158,814 | A | | 5/1939 | Ashcraft | |
| 2,216,676 | A | * | 10/1940 | Ragland | 294/86.24 |
| 2,374,192 | A | | 4/1945 | Godfrey | |
| 2,507,577 | A | * | 5/1950 | Reynolds | 294/94 |
| 2,539,039 | A | | 1/1951 | Siracusa | |
| 2,571,619 | A | * | 10/1951 | Rusk | 294/86.14 |
| 2,589,159 | A | | 3/1952 | Stone | |
| 2,609,720 | A | | 9/1952 | Barnard | |
| 2,707,412 | A | | 5/1955 | Brame | |
| 2,719,051 | A | | 9/1955 | Hankins, Jr. | |
| 2,720,128 | A | | 10/1955 | Woolley | |
| 2,728,600 | A | * | 12/1955 | Gray et al. | 294/96 |
| 2,732,249 | A | | 1/1956 | Siracusa | |
| 2,823,065 | A | | 2/1958 | Henry | |
| 2,823,948 | A | * | 2/1958 | Horton | 294/97 |
| 2,962,919 | A | | 12/1960 | Grundmann et al. | |

(Continued)

FOREIGN PATENT DOCUMENTS

| | | |
|---|---|---|
| DE | 3829909 A1 | 3/1989 |
| EP | 0311455 A1 | 4/1989 |

(Continued)

OTHER PUBLICATIONS

Great Britain Search Report, dated Dec. 17, 2003 for Application No. GB 0321346.9.

(Continued)

*Primary Examiner* — Dean Kramer
(74) *Attorney, Agent, or Firm* — Conley Rose, P.C.

(57) ABSTRACT

An internal pipe gripping tool includes a tool body adapted for insertion into a pipe. A gripper is disposed adjacent and movably coupled to the tool body. The gripper has an engaged position and a released position relative to the tool body. A lever has a first end node, a second end node, and an intermediate node between the first and second end nodes. The first end node is coupled to the tool body, and the intermediate node is coupled to the gripper. A force applied to the second end node results in another force at the intermediate node that shifts the gripper from the engaged position to the released position.

23 Claims, 6 Drawing Sheets

(56) References Cited

U.S. PATENT DOCUMENTS

| | | | | |
|---|---|---|---|---|
| 3,124,023 | A | 3/1964 | Marquis et al. | |
| 3,205,736 | A | 9/1965 | Crickmer | |
| 3,247,742 | A | 4/1966 | Woodbury | |
| 3,272,038 | A | 9/1966 | Burstall | |
| 3,365,762 | A | 1/1968 | Spiri | |
| 3,380,528 | A | 4/1968 | Timmons | |
| 3,847,040 | A | 11/1974 | Bufkin | |
| 3,905,636 | A | 9/1975 | Westerlund | |
| 3,957,113 | A | 5/1976 | Jones et al. | |
| 4,057,887 | A | 11/1977 | Jones et al. | |
| 4,093,294 | A | 6/1978 | Taylor | |
| 4,235,469 | A * | 11/1980 | Denny et al. | 294/96 |
| 4,248,550 | A * | 2/1981 | Blaschke et al. | 405/232 |
| 4,372,026 | A | 2/1983 | Mosing | |
| 4,475,607 | A | 10/1984 | Haney | |
| 4,487,092 | A | 12/1984 | Neves | |
| 4,640,777 | A | 2/1987 | Lemonnier | |
| 4,648,292 | A | 3/1987 | Haynes et al. | |
| 4,649,777 | A | 3/1987 | Buck | |
| 4,709,599 | A | 12/1987 | Buck | |
| 4,746,158 | A | 5/1988 | Fields | |
| 4,836,064 | A | 6/1989 | Slator | |
| 4,869,137 | A | 9/1989 | Slator | |
| 4,997,225 | A | 3/1991 | Denis | |
| 5,161,439 | A | 11/1992 | Wesch, Jr. | |
| 5,172,613 | A | 12/1992 | Wesch, Jr. | |
| 5,193,397 | A | 3/1993 | Hugelier et al. | |
| 5,271,298 | A | 12/1993 | Gazel-Anthoine | |
| 5,335,756 | A | 8/1994 | Penisson | |
| 5,394,774 | A | 3/1995 | Dlask | |
| 5,439,264 | A | 8/1995 | Margiottiello | |
| 5,451,084 | A | 9/1995 | Jansch | |
| 5,484,040 | A | 1/1996 | Penisson | |
| 5,490,702 | A * | 2/1996 | Fleming | 294/97 |
| 5,537,900 | A | 7/1996 | Schaar | |
| 5,609,226 | A | 3/1997 | Penisson | |
| 5,642,912 | A | 7/1997 | Parish, II | |
| 5,819,605 | A | 10/1998 | Buck et al. | |
| 5,845,549 | A | 12/1998 | Bouligny | |
| 5,868,045 | A | 2/1999 | Hauk | |
| 5,971,086 | A | 10/1999 | Bee et al. | |
| 6,010,171 | A | 1/2000 | Margiottiello | |
| 6,069,509 | A | 5/2000 | Labram | |
| 6,070,500 | A | 6/2000 | Dlask et al. | |
| 6,079,509 | A | 6/2000 | Bee et al. | |
| 6,264,395 | B1 | 7/2001 | Allamon et al. | |
| 6,302,410 | B1 | 10/2001 | Wentworth et al. | |
| 6,309,002 | B1 | 10/2001 | Bouligny | |
| 6,431,626 | B1 | 8/2002 | Bouligny | |
| 6,494,516 | B1 * | 12/2002 | Bertini | 294/207 |
| 6,629,568 | B2 | 10/2003 | Post et al. | |
| 6,971,283 | B2 | 12/2005 | Belik | |
| 7,096,952 | B2 | 8/2006 | Harmon et al. | |
| 7,854,258 | B2 | 12/2010 | Sheiretov et al. | |
| 7,909,120 | B2 | 3/2011 | Slack | |
| 8,042,626 | B2 | 10/2011 | Slack | |
| 2002/0108748 | A1 | 8/2002 | Keyes | |
| 2005/0097993 | A1 | 5/2005 | Niven | |
| 2009/0273201 | A1 | 11/2009 | Slack | |

FOREIGN PATENT DOCUMENTS

| | | |
|---|---|---|
| GB | 1452524 | 10/1976 |
| GB | 2100639 A | 1/1983 |
| WO | 9108866 A1 | 6/1991 |

OTHER PUBLICATIONS

Restriction Requirement dated Dec. 16, 2004, U.S. Appl. No. 10/661,707.
Jan. 14, 2005 Response to Dec. 16, 2004 Restriction Requirement, U.S. Appl. No. 10/661,707.
Office Action dated Mar. 14, 2005, U.S. Appl. No. 10/661,707.
Jun. 14, 2005 Response to Mar. 14, 2005 Office Action, U.S. Appl. No. 10/661,707.
Restriction Requirement dated Jul. 28, 2005, U.S. Appl. No. 10/661,800.
Aug. 25, 2005 Response to Jul. 28, 2005 Restriction Requirement, U.S. Appl. No. 10/661,800.
Office Action dated Dec. 19, 2005, U.S. Appl. No. 10/661,800.
Mar. 20, 2006 Response to Dec. 19, 2005 Office Action, U.S. Appl. No. 10/661,800.
Final Office Action dated Jun. 5, 2006, U.S. Appl. No. 10/661,800.
Sep. 5, 2006 Response to Jun. 5, 2006 Final Office Action, U.S. Appl. No. 10/661,800.
Advisory Action dated Nov. 3, 2006, U.S. Appl. No. 10/661,800.
Nov. 5, 2006 Response to Nov. 3, 2006 Advisory Action, U.S. Appl. No. 10/661,800.
Office Action dated Mar. 7, 2007, U.S. Appl. No. 10/661,800.
Jul. 9, 2007 Response to Mar. 7, 2007 Office Action, U.S. Appl. No. 10/661,800.
Office Action dated Sep. 14, 2007, U.S. Appl. No. 10/661,800.
Nov. 13, 2007 Response to Sep. 14, 2007 Office Action, U.S. Appl. No. 10/661,800.
Final Office Action dated Dec. 26, 2007, U.S. Appl. No. 10/661,800.
Office Action dated Dec. 16, 2008, U.S. Appl. No. 12/109,045.
Feb. 9, 2009 Response to Dec. 16, 2008 Office Action, U.S. Appl. No. 12/109,045.
Office Action dated May 28, 2009, U.S. Appl. No. 12/109,045.
Aug. 28, 2009 Response to May 28, 2009 Office Action, U.S. Appl. No. 12/109,045.
Final Office Action dated Dec. 22, 2009, U.S. Appl. No. 12/109,045.
Feb. 3, 2010 Response to Final Office Action dated Dec. 22, 2009, U.S. Appl. No. 12/109,045.

* cited by examiner

INTERNAL PIPE GRIPPING TOOL

TECHNICAL FIELD

The disclosure relates to methods and apparatus for gripping and pulling pipes.

BACKGROUND

Internal pipe gripping tools typically have gripping elements that can be inserted into a pipe and forced into contact with the inner wall of the pipe. Once the gripping elements have engaged the inner wall of the pipe, a pulling force may be applied to the gripping tool to pull the gripping tool and pipe. After the pulling operation, the gripping elements may be released from the inner wall of the pipe to allow the gripping tool to be pulled out of the pipe.

U.S. Pat. No. 2,571,619 ("Rusk") discloses a pipe puller that has a pair of wedge-shaped jaws connected by upper and lower toggle links. The jaws are mounted on an expander wedge. After inserting the pipe puller into a pipe, an auxiliary cable coupled to the upper toggle links is operated such that the jaws ride down the expanded wedge and are forced into frictional contact with the inner wall of the pipe. The toggle links snap into the locked position and keep the jaws in frictional contact with the inner wall of the pipe. With the tool frictionally engaged, another cable coupled to the head of the pipe puller can be used to pull the pipe puller and pipe.

The upper and lower toggle must be moved into the unlocked position in order to be able to release the jaws from frictional contact with the inner wall of the pipe. However, the auxiliary cable is coupled to only the upper toggle link. It does not appear that the auxiliary cable would be effective in moving the lower toggle link to the unlocked position.

SUMMARY

In one aspect of the disclosure, an internal pipe gripping tool comprises a tool body adapted for insertion into a pipe and at least one gripper disposed adjacent to the tool body. The at least one gripper is movably coupled to the tool body and has an engaged position and a released position relative to the tool body. The internal pipe gripping tool includes at least one lever, which has a first end node, a second end node, and an intermediate node between the first and second end nodes. The first end node is coupled to the at least one gripper, and the intermediate node is coupled to the at least one gripper. A force applied to the second end node results in another force at the intermediate node that shifts the at least one gripper from the engaged position to the released position.

In one embodiment, the tool body has a tapered section and a sliding joint is formed between the at least one gripper and the tapered section. In one embodiment, the sliding joint is inclined at an inclination angle that matches a taper angle of the tapered section.

In one embodiment, the internal pipe gripping tool further includes a linkage coupling the at least one gripper to the intermediate node. In one embodiment, a first end of the linkage is coupled to the intermediate node by a rotating joint. In one embodiment, a second end of the linkage is coupled to the at least one gripper by one of a rotating joint, a sliding joint, and a multiple joint. In one embodiment, the second end of the linkage is coupled to the at least one gripper and the tool body by the multiple joint.

In one embodiment, the at least one lever is coupled to the tool body by a rotating joint.

In one embodiment, the tool body has a plurality of radial fins arranged in a cross design. In one embodiment, at least one of the fins is tapered and the at least one gripper is disposed adjacent to and movably coupled to the tapered fin.

In one embodiment, the internal pipe gripping tool further includes a first link member coupled to the tool body and a second link member coupled to the second end node. The first and second link members provide independent paths for applying force to each of the tool body and second end node of the at least one lever.

In one embodiment, the internal pipe gripping tool further includes a slider movably coupled to the tool body and a link between the at least one lever and the slider. A linear translation of the slide along the tool body in a select direction applies the first force to the second end node of the at least one lever.

In one embodiment, the internal pipe gripping tool further includes a first link member coupled to the tool body and a second link member selectively coupled to the slider. The first and second link members provide independent paths for applying force to each of the slider and tool body.

In one embodiment, the internal pipe gripping tool further includes a second gripper disposed adjacent to the tool body. The second gripper is movably coupled to the tool body, is diametrically opposed to the at least one gripper, and has an engaged position and a released position.

In one embodiment, the internal pipe gripping tool further includes a second lever having a first end node, a second end node, and an intermediate node between the first and second end nodes. The first end node of the second lever is coupled to the tool body. The intermediate node of the second lever is coupled to the tool body. The intermediate node of the second lever is coupled to the second gripper. A force applied to the second end node of the second lever results in another force at the intermediate node of the second lever that shifts the second gripper from the engaged position to the released position.

In another aspect of the disclosure, an internal pipe gripping tool comprises a tool body adapted for insertion into a pipe and at least one gripper disposed adjacent to the tool body. The at least one gripper is movably coupled to the tool body and has an engaged position and a released position relative to the tool body. The internal pipe gripping tool includes a slider coupled to the tool body and linearly movable along the tool body. A link couples the at least one gripper to the slider such that a linear motion of the slider in a select direction applies a force to the at least one gripper that shifts the at least one gripper from the engaged position to the released position.

In another aspect of the disclosure, a method of performing an operation on a pipe comprises providing an internal pipe gripping tool having a tool body, at least one gripper adjacent and movably coupled to the tool body, and at least one lever having a first end node coupled to the tool body, a second end node, and an intermediate node between the first and second end nodes coupled to the at least one gripper. The internal pipe gripping tool is lowered towards the pipe. The lowering continues until the at least one lever reaches a locked position wherein the at least one gripper has engaged the inner wall of the pipe.

In one embodiment, the method further includes applying a force to the tool body to pull both the internal pipe gripping tool and the pipe.

In one embodiment, the method further includes applying another force to the second end node of the at least one lever to move the lever away from the locked position to an unlocked position wherein the at least one gripper is released from the inner wall of the pipe.

BRIEF DESCRIPTION OF THE DRAWINGS

The accompanying drawings are included to provide a further understanding of the disclosure and are incorporated in and constitute a part of this specification. The drawings illustrate various embodiments of the disclosure and together with the description serve to explain the principles and operation of the invention. The figures are not necessarily to scale, and certain features and certain views of the figures may be shown exaggerated in scale or in schematic in the interest of clarity and conciseness. The following is a description of the figures.

DETAILED DESCRIPTION

Figure 1A:
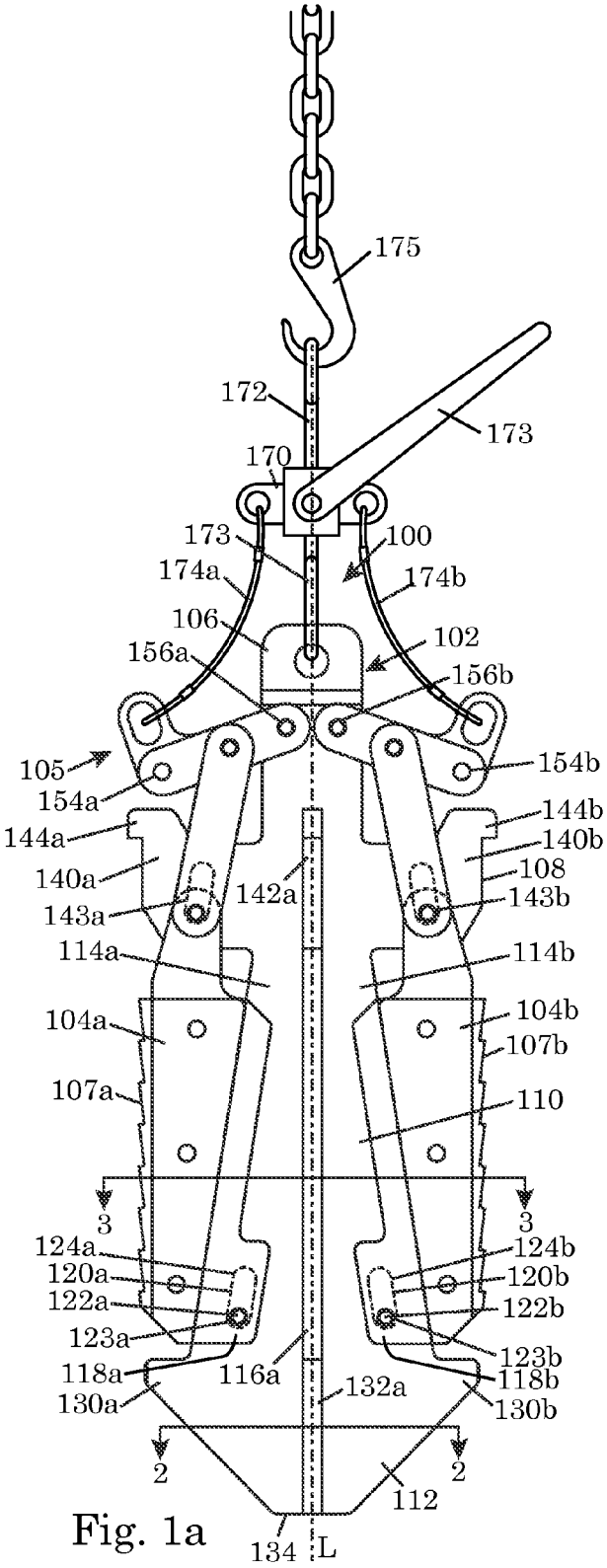
FIG. 1*a* shows an internal pipe gripping tool.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the disclosure. In addition, like or identical reference numerals may be used to identify common or similar elements.

FIG. 1*a* shows an internal pipe gripping tool 100 capable of gripping the inner wall of a pipe. As used herein, the term "pipe" refers to any tubular good that may be gripped from the inside, such as a drill pipe or casing. The internal pipe gripping tool 100 has an axial axis L, a spear 102 having an axial axis that coincides with the axial axis L, and paired grippers 104*a*, 104*b* that are diametrically opposed about the axial axis L. The paired grippers 104*a*, 104*b* are disposed adjacent to opposite sides of the spear 102 and are each coupled to the spear 102. Each of the paired grippers 104*a*, 104*b* is movable relative to the spear 102 by a mechanism 105. Each of the paired grippers 104*a*, 104*b* has a wedge shape and can be wedged into frictional contact with an inner wall of a pipe. The outer surfaces of the grippers 104*a*, 104*b* to be in opposing relation to the inner wall of the pipe may include gripping elements 107*a*, 107*b*, such as teeth or roughened surfaces. The internal pipe gripping tool 100 is adjustable between a locked position, where the grippers 104*a*, 104*b* engage with the inner wall of the pipe, and an unlocked position, where the grippers 104*a*, 104*b* are disengaged or released from the inner wall of the pipe.

The internal pipe gripping tool 100 is useful wherever there is a desire to grip the inside of a pipe. In one example, the internal pipe gripping tool 100 may be used in a pulling application, where the internal pipe gripping tool 100 will grip a target pipe from the inside and a pulling force applied to the internal pipe gripping tool 100 will pull both the internal pipe gripping tool 100 and the pipe. The internal pipe gripping tool 100 may be used to pull a pipe out of a borehole or mousehole, for example. The internal pipe gripping tool 100 may be coupled to a system that can provide the pulling force, such as a top drive system. In another example, the internal pipe gripping tool 100 may be used in a sealing application, e.g., to seal the bore of a pipe. In this example, the paired grippers 104*a*, 104*b* may carry packer elements that will seal against the inner wall of a target pipe when the internal pipe gripping tool 100 is engaged with or locked to the pipe.

Figure 2:
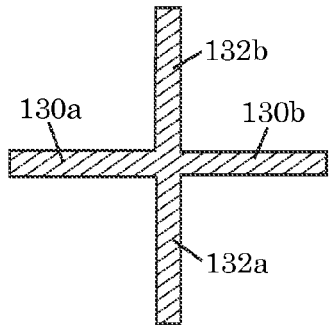
FIG. 2 shows a cross-section of the internal pipe gripping tool of FIG. 1*a* along lines 2-2 of FIG. 1*a*.

In general, the spear 102 is an elongated body that may be inserted into a pipe. In one embodiment, the spear 102 includes a connector 106, an anchor 108, a body 110, and a nose 112. The parts of the spear 102 may be integrally formed or may be formed separately and then connected together using suitable means such as but not limited to welding. The spear nose 112 has first paired fins 130*a*, 130*b* and second paired fins 132*a*, 132*b* (in FIG. 2). The fins 130*a*, 130*b*, 132*a*, 132*b* extend radially relative to the axial axis L. The first paired fins 130*a*, 130*b* are diametrically opposed about the axial axis L. Similarly, the second paired fins 132*a*, 132*b* are diametrically opposed about the axial axis L. The first paired fins 130*a*, 130*b* and second paired fins 132*a*, 132*b* together form a cross design (in FIG. 2). However, the spear nose 112 is not restricted to having four fins or fins in a cross design. Other arrangements of fins and number of fins are possible.

Each of the fins 130*a*, 130*b*, 132*a*, 132*b* is tapered downwardly, from the body end of the spear nose 112 to the tip 134 of the spear nose 112. This gives the spear nose 112 an overall tapered shape. The spear nose 112 may be at the leading end of the internal pipe gripping tool 100 when the internal pipe gripping tool 100 is being lowered into a target pipe. Therefore, the tapered shape of the spear nose 112 would facilitate insertion of the internal pipe gripping tool 100 into the pipe. The spear nose 112 is not restricted to having fins. In some embodiments, the spear nose 112 may have a conical or conical frustum shape in lieu of fins. In other embodiments, the spear nose 112 may have a bull nose shape in lieu of fins. In general, the shape of the spear nose 112 would be selected to facilitate insertion of the internal pipe gripping tool 100 into the target pipe. The overall width of the spear nose 112 should allow the spear nose 112 to be insertable into the pipe without getting stuck in the pipe.

Figure 3:
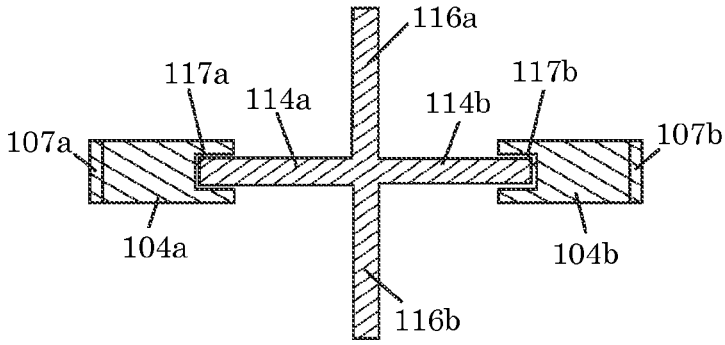
FIG. 3 shows a cross-section of the internal pipe gripping tool of FIG. 1*a* along lines 3-3.

The spear body 110 has first paired fins 114*a*, 114*b* and second paired fins 116*a*, 116*b* (in FIG. 3). The first paired fins 114*a*, 114*b* extend radially relative to the axial axis L and are diametrically opposed about the axial axis L. Similarly, the second paired fins 116*a*, 116*b* extend radially relative to the axial axis L and are diametrically opposed about the axial axis L. The spear body first paired fins 114*a*, 114*b* may be aligned with the spear nose first paired fins 130*a*, 130*b*, respectively. Similarly, the spear body second paired fins 116*a*, 116*b* may be aligned with the spear nose second paired fins 132*a*, 132*b*, respectively. The spear body first paired fins 114*a*, 114*b* and second paired fins 116*a*, 116*b* together form a cross design (in FIG. 3). However, the spear body 110 is not restricted to having four fins or fins in a cross design. Other arrangement of fins and number of fins are possible.

The first paired fins 114*a*, 114*b* are tapered upwardly, from the nose end of spear body 110 to the anchor end of spear body 110. The fins 114*a*, 114*b* extend into slots 117*a*, 117*b* (in FIG. 3) in the inner sides of grippers 104*a*, 104*b*, respectively. The grippers 104*a*, 104*b* are coupled to and movable relative to the fins 114*a*, 114*b*, respectively. The tapered edges of the fins 114*a*, 114*b* define ramps along which the grippers 104*a*, 104*b*, respectively, can move. The positions of the grippers 104*a*, 104*b* relative to the spear 102 determine whether the grippers 104*a*, 104*b* are in the locked position, where they frictionally engage the inner wall of a pipe, or an unlocked position, where they do not frictionally engage the inner wall of a pipe. The fins 116*a*, 116*b* are not coupled to the grippers 104*a*, 104*b*.

In general, the spear body 110 may have any number of fins. Typically, some of the fins, e.g., fins 114*a*, 114*b*, will cooperate with the grippers 104*a*, 104*b* for the locking action of the grippers 104*a*, 104*b* with the inner wall of a pipe. The remaining fins, e.g., fins 116*a*, 116*b*, may act as centralizers or stabilizers when the internal pipe gripping tool 100 is inserted in a pipe. These remaining fins may or may not be tapered. It is also possible that spear body 110 may not have any fins. For example, the spear body 100 may include a conical frustum shape. This may require a redesign of the inner sides of the grippers 104*a*, 104*b* that would be in opposing relation to the spear body 110. In general, the design of the grippers 104*a*, 104*b* should be such that the grippers 104*a*, 104*b* can move along spear body 110 as the internal pipe gripping tool 100 is shifted between the locked and unlocked positions.

The grippers 104*a*, 104*b* are coupled to the spear body fins 114*a*, 114*b* by sliding joints 120*a*, 120*b*, respectively. The sliding joints 120*a*, 120*b* allow the grippers 104*a*, 104*b* to move relative to the fins 114*a*, 114*b*, respectively. In one embodiment, the sliding joints 120*a*, 120*b* are pin-in-slot joints. The sliding joints 120*a*, 120*b* may include holes 123*a*, 123*b* on lower ears 118*a*, 118*b* of the grippers 104*a*, 104*b*, respectively. The sliding joints 120*a*, 120*b* may further include slots 124*a*, 124*b* on the spear body fins 114*a*, 114*b*, respectively. The holes 123*a*, 123*b* are aligned with the slots 124*a*, 124*b*, respectively. Then, pins 122*a*, 122*b* are inserted through the aligned slots and holes to complete the sliding joints 120*a*, 120*b*. It is possible to reverse the locations of the slots and holes for the sliding joints. That is, the holes may be formed in the fins 114*a*, 114*b* and the slots in the gripper ears 118*a*, 118*b*. The slots 124*a*, 124*b* are inclined upwardly. In one embodiment, the inclination angles of the slots 124*a*, 124*b* relative to the axial axis L are selected to match the taper angles of the fins 114*a*, 114*b* relative to the axial axis L, respectively. Alternatively, it can be said that the slots 124*a*, 124*b* are generally parallel to the tapered edges of the fins 114*a*, 114*b*, respectively.

Figure 4:
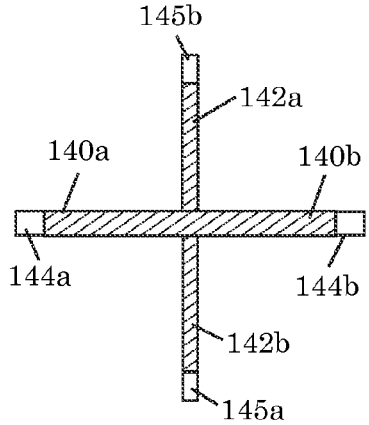
FIG. 4 shows a cross-section of the internal pipe gripping tool of FIG. 1*b* along lines 4-4.

The spear anchor 108 has first paired fins 140*a*, 140*b* and second paired fins 142*a*, 142*b* (in FIG. 4). The first paired fins 140*a*, 140*b* extend radially relative to the axial axis L and are diametrically opposed about the axial axis L. Similarly, the second paired fins 142*a*, 142*b* extend radially relative to the axial axis L and are diametrically opposed about the axial axis L. The spear anchor first paired fins 140*a*, 140*b* may be aligned with the spear body first paired fins 114*a*, 114*b*, and the spear anchor second paired fins 142*a*, 142*b* may be aligned with the spear anchor second paired fins 116*a*, 116*b*. The spear anchor fins 140*a*, 140*b* have lips 144*a*, 144*b*, respectively. Similarly, the spear anchor fins 142*a*, 142*b* have lips 145*a*, 145*b* (in FIG. 4), respectively. The lips 144*a*, 144*b*, 145*a*, 145*b* function collectively as a flange that may engage an upper end of a pipe and thereby prevent the internal pipe gripping tool 100 from being fully inserted into a target pipe. The lips may simply sit on the rim of the pipe. In alternate embodiments, the lips may be omitted so that the internal pipe gripping tool can be fully inserted into the pipe.

Figure 1B:
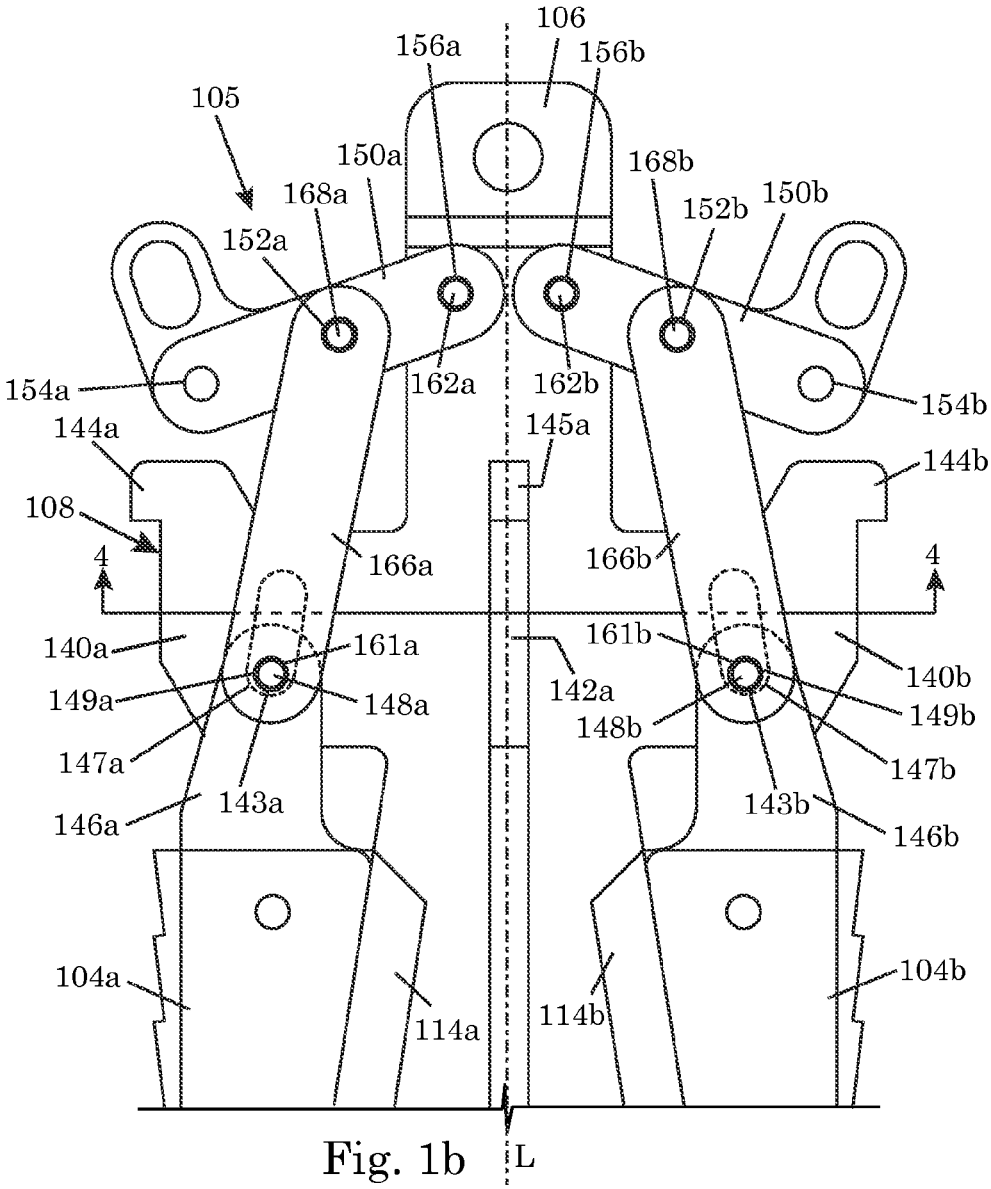
FIG. 1*b* shows an enlarged portion of the internal pipe gripping tool of FIG. 1*a*.

The mechanism 105 for shifting the internal pipe gripping tool 100 between locked and unlocked positions is shown in enlarged view in FIG. 1*b*. The mechanism 105 has levers 150*a*, 150*b*. The lever 150*a* is a rigid bar with end nodes 154*a*, 156*a* and an intermediate node 152*a*. The intermediate node 152*a* is between the end nodes 154*a*, 156*a* and may or may not be equidistant from the end nodes 154*a*, 156*a*. Typically, the intermediate node 152*a* will be closer to the inner end node 156*a*. Similarly, the lever 150*b* is a rigid bar having end nodes 154*b*, 156*b* and an intermediate node 152*b*. Also, the intermediate node 152*b* is between the end nodes 154*b*, 156*b* and may or may not be equidistant from the end nodes 154*b*, 156*b*. Typically, the intermediate node 152*b* will be closer to the inner end node 156*b*. The end nodes 154*a*, 156*a* may also be referred to, alternately, as first and second end nodes. The end nodes 154*b*, 156*b* may also be referred to, alternately, as first and second end nodes.

The inner end nodes 156*a*, 156*b* are connected to opposite sides of the spear connector 106 by rotating joints 162*a*, 162*b*, respectively. In one embodiment, the rotating joints 162*a*, 162*b* are pin joints. Force applied to the spear connector 106 may move the spear connector 106 along the axial axis L. Because the inner end nodes 156*a*, 156*b* are connected to the spear connector 106, they will move with the spear connector 106. Forces applied to the outer end nodes 154*b*, 156*b* will result in forces at the intermediate nodes 152*a*, 152*b*, respectively. The intermediate nodes 152*a*, 152*b* are coupled to the grippers 104*a*, 104*b*, respectively, such that forces at the intermediate nodes 152*a*, 152*b* are transferred to the grippers 104*a*, 104*b* and are effective in moving the grippers 104*a*, 104*b* relative to the spear 102.

With the mechanism 105, force can be applied to the inner end nodes 156*a*, 156*b* through the spear connector 106 to lock the internal pipe gripping tool 100 to a pipe or forces can be applied to the intermediate end nodes 152*a*, 152*b* through the outer end nodes 154*a*, 154*b* to unlock the internal pipe gripping tool 100 from a pipe. FIG. 1*a* shows one arrangement for applying forces to the nodes. A handle 172 is coupled to the spear connector 106. The handle 172 passes through the center of a pull bar 170, and the pull bar 170 may slide up and down the handle 172. The outer lever end nodes 154*a*, 154*b* are coupled to the ends of the pull bar 170 by links 174*a*, 174*b*, respectively. In one embodiment, the links 174*a*, 174*b* are flexible links, such as cables or chains.

A hook 175 may be used to grab the handle 172 to allow force to be applied to the spear connector 106 through the handle 172. The hook 175 may be connected to a suitable machine capable of supporting and moving weight, such as a top drive. Since the pull bar 170 is not physically connected to the handle 172, the force applied to the handle 172 will not be transferred to the links 174*a*, 174*b*, and the links 174*a*, 174*b* will remain slack. When it is desired to apply forces to the links 174*a*, 174*b*, the hook 175 is disconnected from the handle 172 and connected to the handle 173. The hook 175 is adjusted to move the handle 173 to an upright position and then pull on the handle 173. Since the handle 173 is attached to the pull bar 170, the force applied to the handle 173 will move the pull bar 170 up so that the links 174*a*, 174*b* are pulled taut. In this mode, force applied to the handle 173 will be transferred to the links 174*a*, 174*b* and ultimately to the outer lever end nodes 154*a*, 154*b*. The arrangement of handles, pull bar, and links allow forces to be applied separately or independently to the spear connector 106 and outer lever end nodes 154*a*, 154*b*. That is, force can be applied to the spear connector and not the outer lever end nodes, or vice versa. Other arrangements that can allow forces to be applied separately to the spear connector 106 and outer lever end nodes 154*a*, 154*b* may be used.

In FIG. 1*b*, the intermediate nodes 152*a*, 152*b* are coupled to the grippers 104*a*, 104*b* by linkages 166*a*, 166*b*, respectively. Rotating joints 168*a*, 168*b*, such as pin joints, are formed between the linkages 166*a*, 166*b* and the intermediate nodes 152*a*, 152*b*, respectively. In one embodiment, multiple joints 147*a*, 147*b* are disposed between the linkages 166*a*, 166*b*, the grippers 104*a*, 104*b*, and the spear anchor fins 140*a*, 140*b*. In one embodiment, the multiple joints 147*a*, 147*b* are each a combination of a rotating joint and a sliding joint. For example, the linkages 166*a*, 166*b* have holes 161*a*, 161*b*, respectively. The grippers 104*a*, 104*b* have upper ears 146*a*, 146*b*, and holes 143*a*, 143*b* are formed in the gripper ears 146*a*, 146*b*, respectively. The spear anchor fins 140*a*, 140*b* have slots 149*a*, 149*b*, respectively. The multiple joint 147*a* is formed by aligning hole 161*a*, hole 143*a*, and slot 149*a* and inserting pin 148*a* through the aligned holes and slot. Similarly, the multiple joint 147*b* is formed by aligning hole 161*b*, hole 143*b*, and slot 149*b* and inserting pin 148*b* through the aligned holes and slot.

The multiple joints 147*a*, 147*b* provide pin-in-slot joints between the spear anchor fins 140*a*, 140*b* and linkages 166*a*, 166*b*, respectively. Also, the multiple joints 147*a*, 147*b* provide pin joints between the upper gripper ears 146*a*, 146*b*, respectively. However, it is possible to separate out the pin-in-slot and pin joints instead of combining them into multiple joints. What is important is that forces applied to the intermediate nodes 152*a*, 152*b* can be used to move the grippers 104*a*, 104*b* relative to the spear 102 in a guided fashion. For example, pin-in-slot joints may be formed between the spear anchor fins 140*a*, 140*b* and the grippers 104*a*, 104*b*, respectively, and pin joints may be formed between the linkages 166*a*, 166*b* and the grippers 104*a*, 104*b*, respectively. In this way, the pin joints will allow the grippers 104*a*, 104*b* to move with the linkages 166*a*, 166*b*, respectively, and the motion of the grippers 104*a*, 104*b* relative to the spear 102 is guided by the pin-in-slot joints.

For the configuration shown in FIG. 1*b*, when pulling forces are applied to the intermediate nodes 152*a*, 152*b*, the linkages 166*a*, 166*b* will move up. As the linkages 166*a*, 166*b* move up, the grippers 104*a*, 104*b* will also move up, and so will the pins 148*a*, 148*b*. In one embodiment, the slots 143*a*, 143*b* are parallel to the slots 124*a*, 124*b* (in FIG. 1*a*), respectively. This enables the grippers 104*a*, 104*b* to move along the ramp created by the tapered edges of the body fins 114*a*, 114*b*.

Figure 5A:
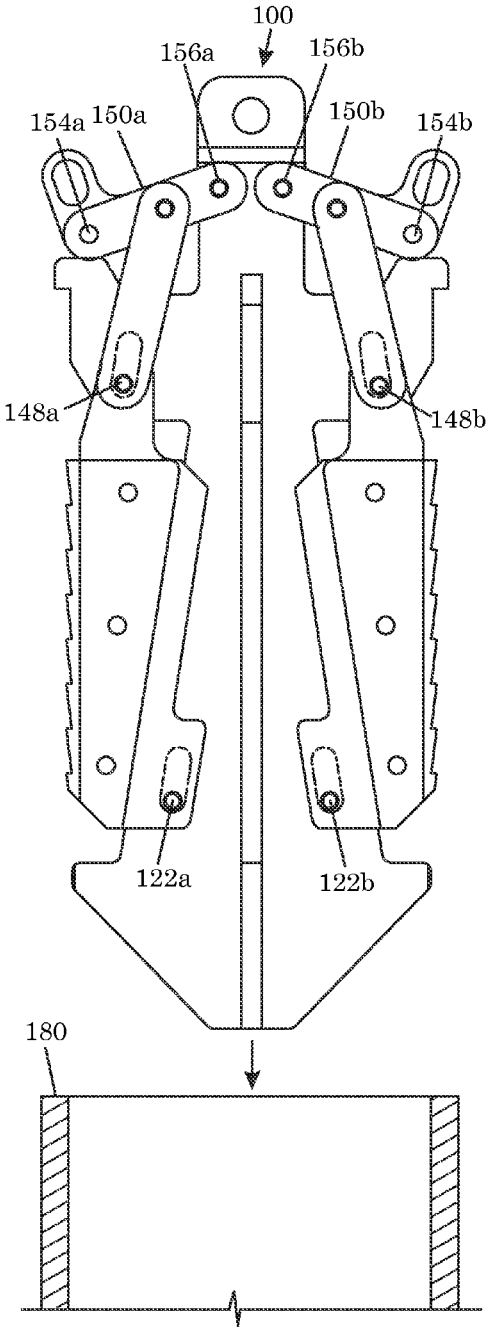
FIG. 5*a* shows an internal pipe gripping tool suspended above a pipe.

In FIG. 5*a*, the internal pipe gripping tool 100 is being lowered into a pipe 180. In this state, in one embodiment, the levers 150*a*, 150*b* are tilted upwardly, with the inner end nodes 156*a*, 156*b* being axially displaced from or higher than the outer end nodes 154*a*, 154*b*. The pins 148*a*, 148*b*, 122*a*, 122*b* are at the lowermost positions in their respective slots. In alternate embodiments, it may be possible to configure the levers 150*a*, 150*b* such that the levers are tilted downwardly or are horizontal while the pipe is being lowered.

Figure 5B:
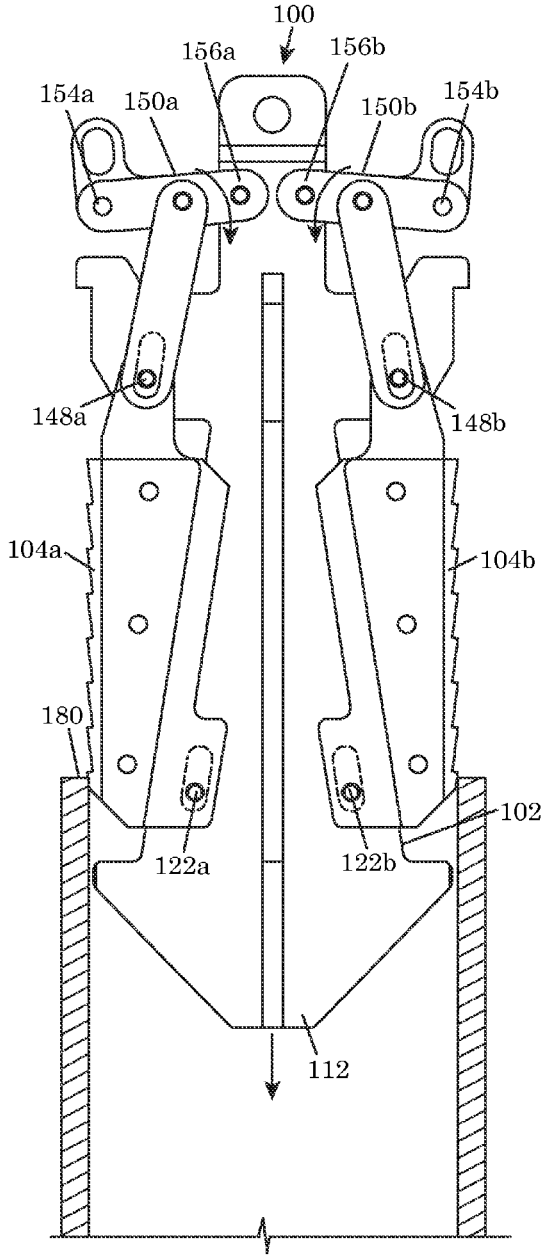
FIG. 5*b* shows an internal pipe gripping tool being lowered into a pipe.

In FIG. 5*b*, the spear nose 112 has been inserted into the pipe 180, and the internal pipe gripping tool 100 is still being lowered into the pipe 180. In this state, frictional forces are being created from contact between the grippers 104*a*, 104*b* and the inner wall of the pipe 180. The net forces acting on the internal pipe gripping tool 100 result in a relative motion between the grippers 104*a*, 104*b* and the spear 102, whereby the spear 102 moves axially or down relative to the grippers 104*a*, 104*b*. As the spear 102 moves down, the levers 150*a*, 150*b* begin to rotate inwardly. That is the inner end nodes 156*a*, 156*b* begin to move down, or axially downward, and the end nodes 154*a*, 154*b* begin to move up, or axially upward. Also, pins 148*a*, 148*b*, 122*a*, 122*b* begin to move up their respective slots.

Figure 5C:
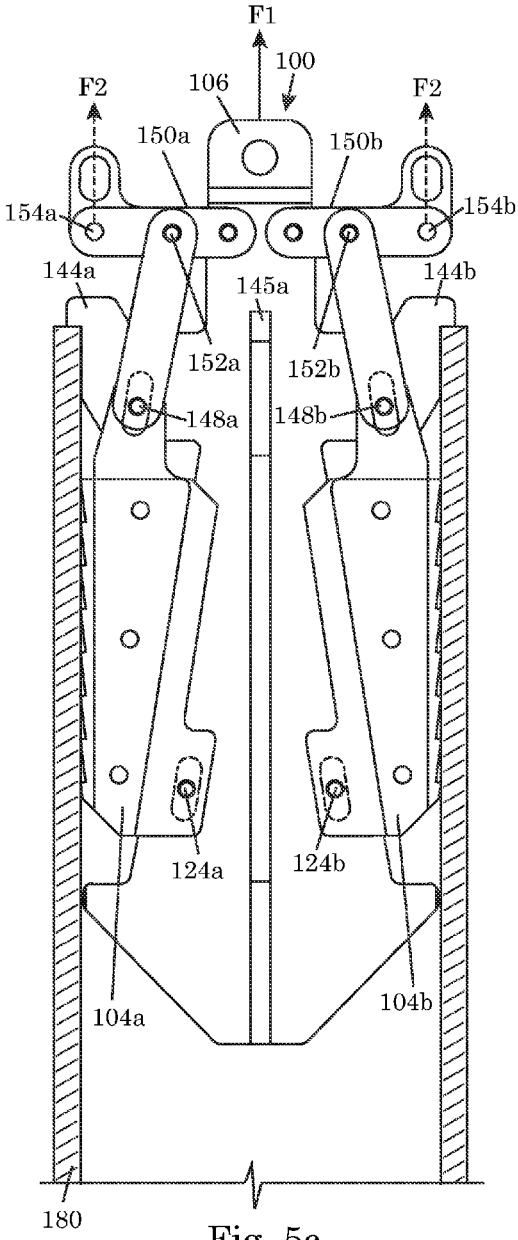
FIG. 5*c* shows an internal pipe gripping tool engaged with a pipe.

In FIG. 5*c*, the levers 150*a*, 150*b* have reached a locked position. In one embodiment, the levers 150*a*, 150*b* are horizontal in the locked position. In alternate embodiments, it may be possible to configure the levers 150*a*, 150*b* such that they are not horizontal in the locked position. The grippers 104*a*, 104*b* have frictionally engaged the inner wall of the pipe 180, forming wedges between the inner wall of the pipe 180 and spear 102. Anchor lips 144*a*, 144*b*, 145*a*, 145*b* (in FIG. 4) are sitting at the upper end of the pipe 180. The pins 148*a*, 148*b*, 122*a*, 122*b* are about midway in their respective slots. A pulling force F1 may be applied to the pipe gripping tool 100 via the spear connector 106 to pull both the internal pipe gripping tool and the pipe 108.

Figure 5D:
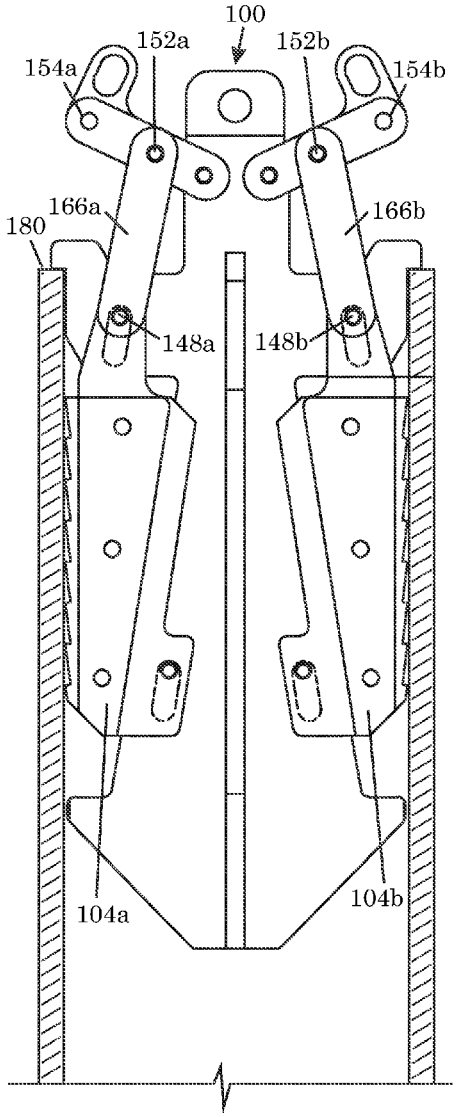
FIG. 5*d* shows an internal pipe gripping tool disengaged from a pipe.

To unlock the internal pipe gripping tool 100 from the pipe 108, the outer end nodes 154*a*, 154*b* are pulled up, as indicated by arrows F2. This causes the intermediate nodes 152*a*, 152*b* to axially displace or move up, as shown in FIG. 5*d*. The forces created at the intermediate nodes 152*a*, 152*b* will be determined by the mechanical advantage of the levers 150*a*, 150*b* and may be several times higher than the forces applied at the outer end nodes 154*a*, 154*b*. As the intermediate nodes 152*a*, 152*b* move up, they pull up the linkages 166*a*, 166*b* and grippers 104*a*, 104*b*. Eventually, the grippers 104*a*, 104*b* will be released from the inner wall of the pipe 180. This may be when the pins 148*a*, 148*b*, 122*a*, 122*b* are at the uppermost positions in their respective slots. In one embodiment, the levers 150*a*, 150*b* are tilted downwardly when the grippers 104*a*, 104*b* are released from the inner wall of the pipe 180. In alternate embodiments, it may be possible to configure the levers 150*a*, 150*b* such that they are not tilted upwardly or are horizontal when the grippers are released. Once the grippers 104*a*, 104*b* are released, the internal pipe gripping tool 100 can be removed from the pipe 180.

Figure 6A:
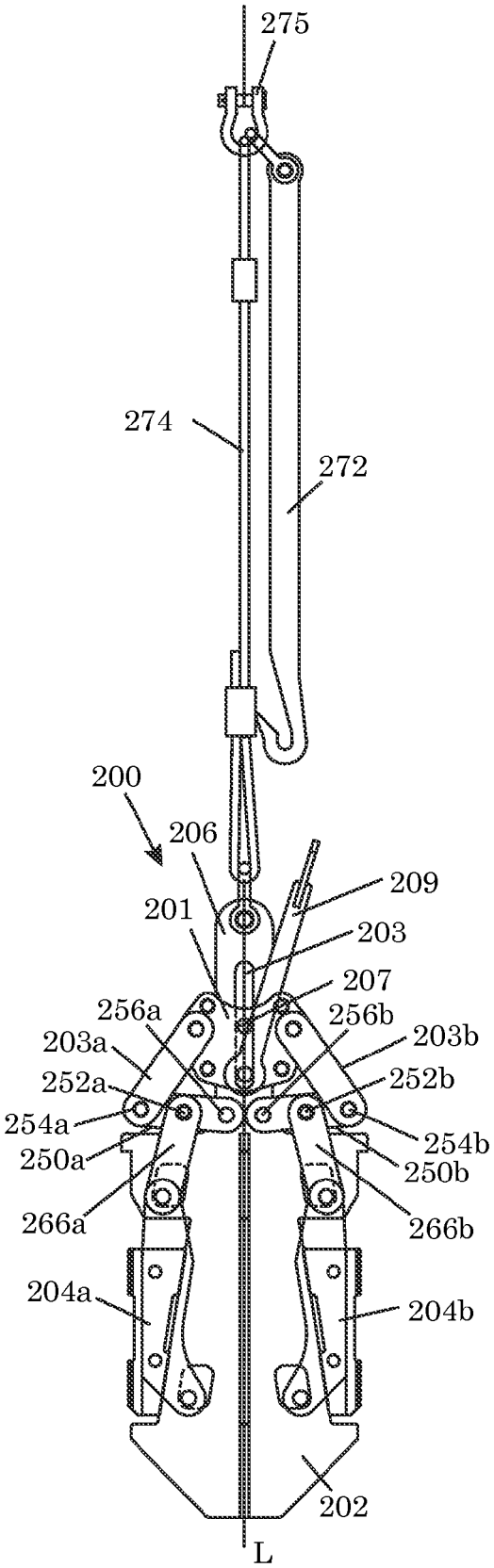
FIG. 6*a* shows another internal pipe gripping tool in a locked position.

FIG. 6*a* shows an internal pipe gripping tool 200, which is the pipe gripping tool 100 with a modification to the mechanism for shifting the tool between the locked and unlocked positions. The pipe gripping tool 200 has a spear 202 and paired grippers 204*a*, 204*b*. The paired grippers 204*a*, 204*b* are adjacent to and movably coupled to the spear 202 as explained above for the internal pipe gripping tool 100. A slide 201 is mounted on the spear connector 206 and movable linearly along axial axis L of the internal pipe gripping tool 200. The slide 201 may be a bracket with a pin 207 at its underside that fits into a linear slot 203 in the spear connector 206. A handle 209 is attached to the slide 201.

The internal pipe gripping tool 200 has levers 250*a*, 250*b*. The inner end nodes 256*a*, 256*b* of the levers 250*a*, 250*b* are attached to the spear connector 206 at a position axially displaced from or below the slide 201. Intermediate nodes 252*a*, 252*b* of the levers 250*a*, 250*b* are coupled to the grippers 204*a*, 204*b* via linkages 266*a*, 266*b* and moving (or multiple) joints as explained above for the internal pipe gripping tool 100 (in FIG. 6*a*, nodes 252*a*, 252*b* are behind linkages 266*a*, 266*b*, respectively, at the locations indicated by 252*a*, 252*b*). Linkages 203*a*, 203*b* couple outer end nodes 254*a*, 254*b* of the levers 250*a*, 250*b* to the slide 201. The joints between the linkages 203*a*, 203*b* and the outer end nodes 254*a*, 254*b* may be rotating joints, such as pin joints. Similarly, the joints between the linkages 203*a*, 203*b* and the slide 201 may be rotating joints, such as pin joints.

Figure 6B:
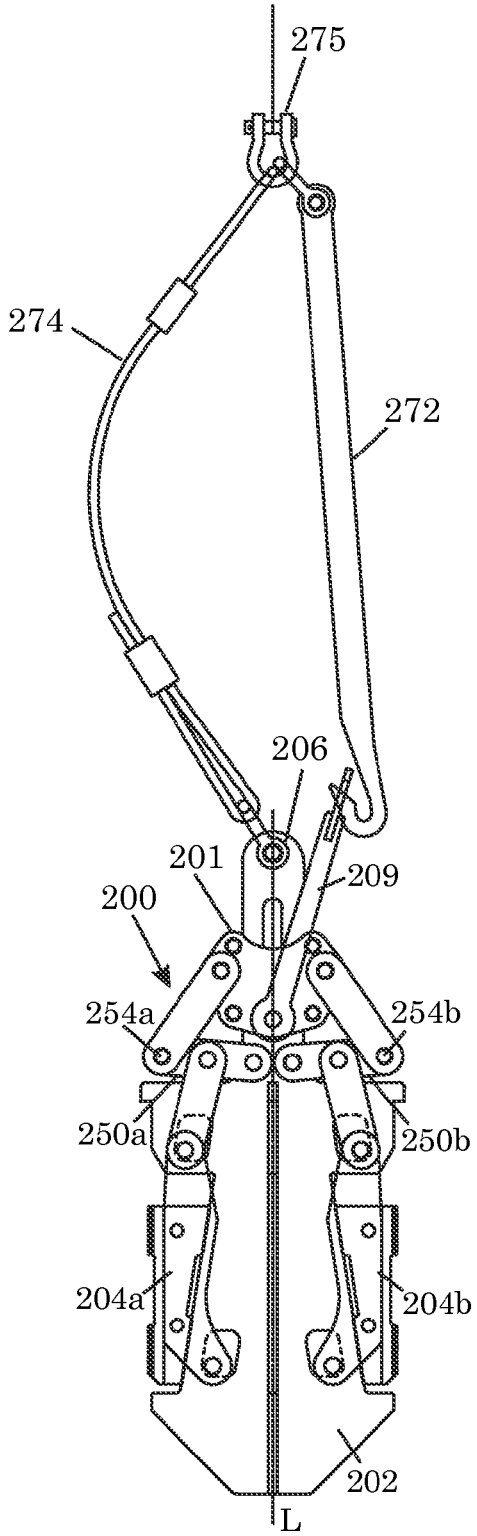
FIG. 6*b* shows the internal pipe gripping tool of FIG. 6*a* as it is being transitioned from a locked position to an unlocked position.
Figure 6C:
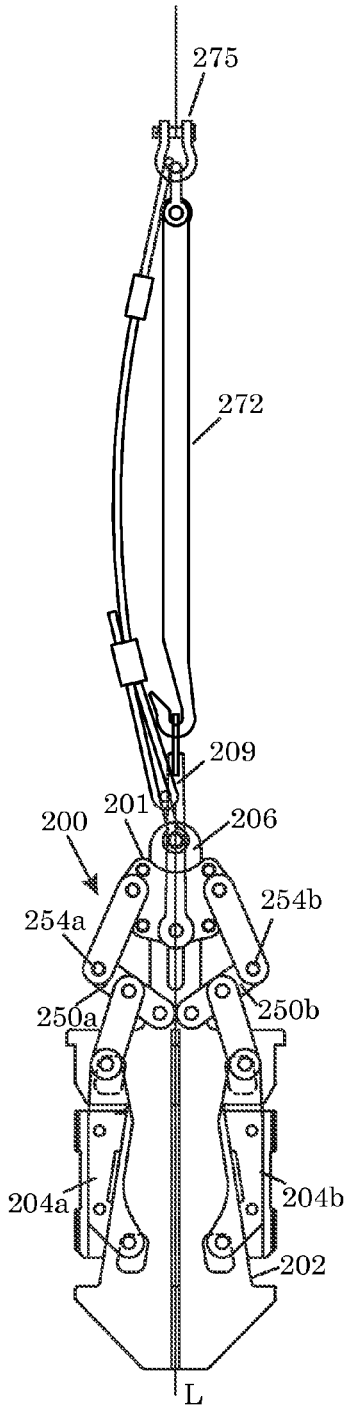
FIG. 6*c* shows the internal pipe gripping tool of FIG. 6*b* in an unlocked position.

A cable 274 has one end coupled to a union 275 and another end coupled to the spear connector 206. A hook 272 has one end coupled to the union 275 and another end that may be selectively coupled to the handle 209. When the hook 272 is not coupled to the handle 209, the slide 201 moves to its lower position on the connector part 206 due to gravity. Also, the cable 274 is taut due to the weight of the pipe gripping tool 200 and gravity. In this position, the internal pipe gripping tool 200 may be inserted into a pipe, and the mechanism for gripping the pipe would be the same as explained above for the internal pipe gripping tool 100. Once the internal pipe gripping tool 200 has gripped the pipe, it is possible to pull up the internal pipe gripping tool 200 and pipe. When it is desired to unlock the internal pipe gripping tool 200 from the pipe, the hook 272 will be connected to the handle 209 of the slider 201, as shown in FIG. 6*b*, and then used to move the slider 201 up the spear connector 206, as shown in FIG. 6*c*. This will move the outer end nodes 254*a*, 254*b* of the levers 250*a*, 250*b* up, releasing the grippers 204*a*, 204*b* from the pipe. The mechanism for releasing the grippers 204*a*, 204*b* is the same as explained above for the internal pipe gripping tool 100.

Figure 7:
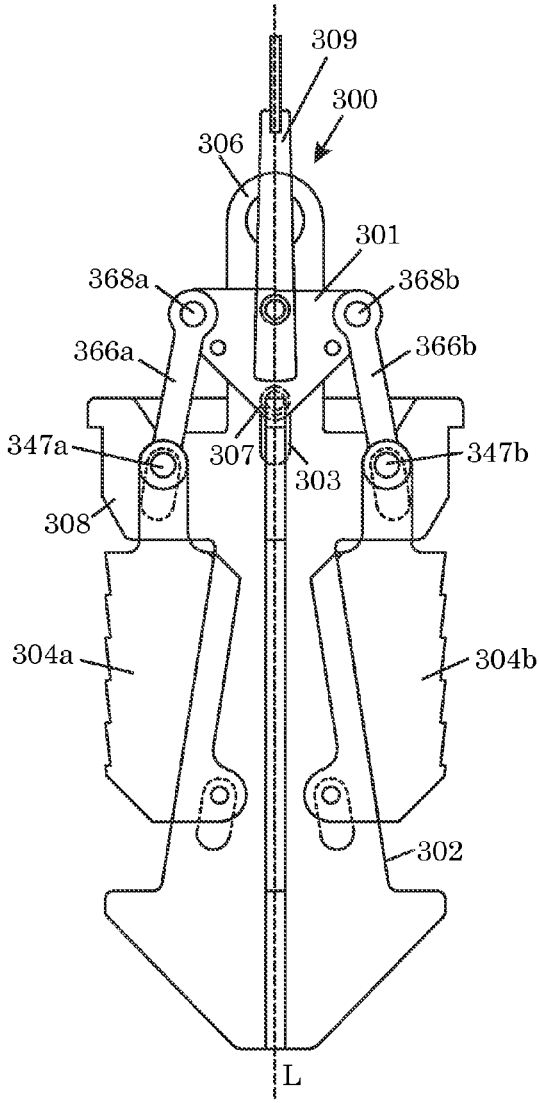
FIG. 7 shows another internal pipe gripping tool.

FIG. 7 shows an internal pipe gripping tool 300, which is the internal pipe gripping tool 100 with a modification to the mechanism for shifting the tool between the locked and unlocked positions. The internal pipe gripping tool 300 has a spear 302 and grippers 304*a*, 304*b*, which are adjacent and movably coupled to the spear 302 as explained above for internal pipe gripping tool 100. A slide 301 is mounted on the spear connector 306 of the spear 302 and movable linearly along axial axis L of the internal pipe gripping tool 300. The slide 301 may be a bracket with an associated pin 307 that fits into a linear slot 303 in the spear connector 306. A handle 309 is attached to the slide 301. The internal pipe gripping tool 300 does not have levers. Rather, linkages 366*a*, 366*b* are coupled at one end to the grippers 304*a*, 304*b* and spear anchor 308 via multiple joints 347*a*, 347*b*. Also, linkages 366*a*, 366*b* are coupled at the other end to the slider 301 via rotating joints 368*a*, 368*b* such as pin joints. The grippers 304*a*, 304*b* will move as the slider 301 moves. To lock the internal pipe gripping tool 300 to a pipe, the internal pipe gripping 300 is inserted into a pipe and the slider 301 is allowed to fall to a lower position on the spear connector 306. To unlock the internal pipe gripping tool 300 from a pipe, the slider 301 is moved up the spear connector 306.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. An internal pipe gripping tool, comprising:

a tool body having a central axis and is adapted for insertion into a pipe;

at least one gripper disposed adjacent to the tool body, the at least one gripper being movably coupled to the tool body and having an engaged position and a released position relative to the tool body; and at least one lever coupled to the tool body at a first location on the lever, the at least one lever coupled to the at least one gripper at a second location on the lever, wherein a first force applied to the lever at a third location results in a second force that shifts the at least one gripper from the engaged position to the released position;

wherein the first force is oriented in an axially upward direction;

wherein the second force is greater than the first force.

2. An internal pipe gripping tool according to claim 1, wherein the tool body has a tapered section and a sliding joint is formed between the at least one gripper and the tapered section.

3. An internal pipe gripping tool according to claim 2, wherein the sliding joint is inclined at an inclination angle that matches a taper angle of the tapered section.

4. An internal pipe gripping tool according to claim 1, further comprising a linkage coupled to the lever at the third location.

5. An internal pipe gripping tool according to claim 4, wherein a first end of the linkage is coupled to the lever at the third location by a rotating joint.

6. An internal pipe gripping tool according to claim 5, wherein a second end of the linkage is coupled to the at least one gripper by one of a rotating joint, a sliding joint, and a multiple joint.

7. An internal pipe gripping tool according to claim 6, wherein the second end of the linkage is coupled to the at least one gripper and the tool body by the multiple joint.

8. An internal pipe gripping tool according to claim 1, wherein the at least one lever is coupled to the tool body by a rotating joint.

9. An internal pipe gripping tool according to claim 1, wherein the tool body has a plurality of radial fins arranged in a cross design.

10. An internal pipe gripping tool according to claim 9, wherein at least one of the fins is tapered and the at least one gripper is disposed adjacent to and movably coupled to the tapered fin.

11. An internal pipe gripping tool according to claim 1, further comprising a first link member coupled to the tool body and a second link member coupled to the lever at the third location, the first and second link members providing independent paths for applying force to each of the tool body and the third location of the at least one lever.

12. An internal pipe gripping tool according to claim 1, further comprising a slider movably coupled to the tool body and a link between the at least one lever and the slider, wherein a linear translation of the slider along the tool body in a select direction applies the first force to the at the third location of the at least one lever.

13. An internal pipe gripping tool according to claim 12, further comprising a first link member coupled to the tool body and a second link member selectively coupled to the slider, the first and second link members providing independent paths for applying force to each of the slider and tool body.

14. An internal pipe gripping tool according to claim 1, further comprising a second gripper disposed adjacent to the tool body, the second gripper being movably coupled to the tool body, being diametrically opposed to the at least one gripper, and having an engaged position and a released position.

15. An internal pipe gripping tool according to claim 14, further comprising a second lever coupled to the tool body at a first location on the second lever, the second lever coupled to the second gripper at a second location on the second lever, wherein a force applied to a third location on the second lever results in another force that shifts the second gripper from the engaged position to the released position.

16. An internal pipe gripping tool, comprising:

a tool body adapted for insertion into a pipe;

at least one gripper disposed adjacent to the tool body, the at least one gripper being movably coupled to the tool body and having an engaged position and a released position relative to the tool body;

a slider coupled to the tool body and linearly movable along the tool body; and a link coupling the at least one gripper to the slider such that a first tension force applied to the slider results in a second force that shifts the at least one gripper from the engaged position to the released position;

wherein the second force is greater than the first force;

wherein engagement between the at least one gripper and an inner surface of a pipe moves the at least one gripper into the engaged position.

17. The internal pipe gripping tool according to claim 16, wherein the tool body has a tapered section and a sliding joint is formed between the at least one gripper and the tapered section.

18. The internal pipe gripping tool according to claim 17, wherein the sliding joint is inclined at an inclination angle that matches a taper angle of the tapered section.

19. The internal pipe gripping tool according to claim 16, wherein the tool body has a tapered section and a sliding joint is formed between the at least one gripper and the tapered section.

20. The internal pipe gripping tool according to claim 16, wherein the tool body has a plurality of radial fins arranged in a cross design.

21. The internal pipe gripping tool according to claim 16, further comprising a second gripper disposed adjacent to the tool body, the second gripper being movably coupled to the tool body, being diametrically opposed to the at least one gripper, and having an engaged position and a released position.

22. A method of performing an operation on a pipe, comprising:

providing an internal pipe gripping tool having a spear, at least one gripper disposed adjacent to the spear and movably coupled to the spear, and at least one lever coupled to the at least one gripper;

lowering the internal pipe gripping tool towards the pipe;

continuing lowering of the internal pipe gripping tool until the at least one lever reaches a locked position wherein the at least one gripper has engaged the inner wall of the pipe; and disengaging the at least one gripper from the inner wall of the pipe to reach a released position by applying a first axially upward oriented force to the lever that generates a second force greater than the first force.

23. The method of claim 22, further comprising applying a second force to a tool body of the internal pipe gripping tool to pull both the internal pipe gripping tool and the pipe.

* * * * *